US008657221B2

(12) United States Patent
Matsumoto et al.

(10) Patent No.: US 8,657,221 B2
(45) Date of Patent: Feb. 25, 2014

(54) ROLLER MILL STRUCTURE

(75) Inventors: Shinji Matsumoto, Nagasaki (JP); Tsugio Yamamoto, Nagasaki (JP); Kazuhiro Takeuchi, Nagasaki (JP); Masahiko Taniguchi, Nagasaki (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 55 days.

(21) Appl. No.: 12/746,054

(22) PCT Filed: Jun. 3, 2008

(86) PCT No.: PCT/JP2008/060233

§ 371 (c)(1),
(2), (4) Date: Jun. 3, 2010

(87) PCT Pub. No.: WO2009/093346

PCT Pub. Date: Jul. 30, 2009

(65) Prior Publication Data

US 2010/0276525 A1 Nov. 4, 2010

(30) Foreign Application Priority Data

Jan. 24, 2008 (JP) ..... 2008-013920

(51) Int. Cl.
*B02C 15/00* (2006.01)

(52) U.S. Cl.
USPC ..... 241/119; 241/121

(58) Field of Classification Search
USPC ..... 241/119, 117
See application file for complete search history.

(56) References Cited

U.S. PATENT DOCUMENTS 4,597,537 A 7/1986 Misaka et al.
4,982,905 A * 1/1991 Holsiepe et al. ..... 241/79.1

(Continued)

FOREIGN PATENT DOCUMENTS

EP 0 842 702 A1 5/1998
ES 2 042 935 T3 12/1993

(Continued)

OTHER PUBLICATIONS

International Search Report of PCT/JP2008/060233, Mailing Date of Jul. 22, 2008.

(Continued)

*Primary Examiner* — Faye Francis
(74) *Attorney, Agent, or Firm* — Westerman, Hattori, Daniels & Adrian, LLP

(57) ABSTRACT

A roller mill structure which achieves uniform distribution of fine particles passed through a rotary classifier to fine particle exits disposed at four points when conveying as pulverized coal milled in the roller mill on the air current is provided. A roller mill structure is configured to discharge pulverized coal obtained by milling a raw coal, which is loaded in a mill body (11), from fine particle exits (14) formed on the top of the mill body so as to be quartered in the circumferential direction to the outside by air current conveyance. The roller mill structure includes a table which rotates in the mill body (11), three rollers for rotating on the table and milling the raw coal, and a rotary classifier (20) disposed upstream of the fine particle exits (14), wherein a movable vane (21) for partly narrowing the cross-sectional area of a flow channel is provided at a midpoint of the flow channel for fine particle current flowing into the interior of the rotary classifier (20), and proceeding toward the fine particle exits (14).

5 Claims, 5 Drawing Sheets

(56) References Cited

U.S. PATENT DOCUMENTS

| | | | | |
|---|---|---|---|---|
| 5,381,968 | A * | 1/1995 | Lohnherr et al. | 241/19 |
| 5,971,302 | A * | 10/1999 | Doumet | 241/17 |
| 6,966,508 | B2 * | 11/2005 | Levy et al. | 241/119 |
| 8,136,746 | B2 * | 3/2012 | Martin et al. | 241/19 |
| 2004/0188554 | A1 * | 9/2004 | Levy et al. | 241/119 |

FOREIGN PATENT DOCUMENTS

| | | | |
|---|---|---|---|
| JP | 59-049855 | A | 3/1984 |
| JP | 63-258655 | A | 10/1988 |
| JP | 01-120948 | U | 8/1989 |
| JP | 6-238184 | A | 8/1994 |
| JP | 09-122516 | A | 5/1997 |
| JP | 10-057828 | A | 3/1998 |
| JP | 2000-093820 | A | 4/2000 |

OTHER PUBLICATIONS

Japanese Office Action dated Oct. 9, 2012, issued in corresponding Japanese Patent Application No. 2008-306574 (3 pages).

Spanish Search Report dated Nov. 27, 2012, issued in corresponding Spanish Patent Application No. 201090042, (4 pages).

Japanese Office Action dated May 28, 2013, issued in corresponding Japanese Patent Application No. 2008-306574, w/ English translation.

Completion of Final Requirements dated Jul. 23, 2013, issued in Filipino Patent Application No. 1-2010-501168.

* cited by examiner

ROLLER MILL STRUCTURE

TECHNICAL FIELD

The present invention relates to a roller mill structure applied, for example, a pulverized coal fired boiler.

BACKGROUND ART

In the related art, pulverized coal obtained by loading raw coal into a roller mill is used as fuel in a coal fired boiler. In the interior of the roller mill, the raw coal is milled into powder, and the milled pulverized coal is dried, classified, and convey on the air current through a pulverized coal tube installed on the top of the roller mill to a boiler by primary air.

FIG. 5 shows an example of configuration of the pulverized coal fired boiler. In this boiler, four roller mills 10 are installed for a furnace 1 having a rectangular cross section. Each of the roller mills 10 is connected to the furnace 1 by four independent pulverized coal tubes 2, and the pulverized coal as fuel is supplied to each wall surface of the furnace 1 through the air current conveyance. The four roller mills 10 each supply pulverized coal to the wall surfaces at different heights.

An example of configuration of the roller mill 10 will be described in brief according to FIG. 6 and FIG. 7.

The roller mill 10 in the drawing is an apparatus for milling raw coal loaded into the mill body 11 between a rotary table 12 and rollers 13, and supplying the pulverized coal (powder) having a predetermined grain diameter or smaller one separated by a rotary classifier 20 to the furnace 1 through the air current conveyance. There are provided three such rollers 13 at regular pitches circumferentially of the rotary table 12, and are turned with the upper surface of the rotary table 12 in association with the rotation thereof.

Opening on the top of the mill body 11 are fine particle exits 14 for discharging the pulverized coal classified by the rotary classifier 20 outside through the air current conveyance. The fine particle exits 14 open in a state of being circumferentially quartered, and the above-described pulverized coal tubes 2 are connected to the fine particle exits 14 individually. In other words, the rotary classifier 20 has the circumferentially quartered fine particle exits 14 opened on the top thereof.

Reference numeral 15 in the drawing designates a raw coal adding tube which penetrates through the center of axis of the rotary classifier 20, and reference numeral 16 designates an air-supply pipe which supplies primary air for the air current conveyance into the mill body 11. The primary air supplied to the interior of the mill body 11 through the air-supply pipe 16 flows out from air outlet 17 provided on an outer peripheral portion of the rotary table 12 into the interior of the mill body 11 to convey the pulverized coal.

Reference numeral 18 in the drawing designates a vane, and the vane 18 has a function to introduce air current in the mill body 11 in the direction of axial center thereof to provide a rotation.

As a technical literature relating to the roller mill for milling coal in the related art, there is the one in which a technology to achieve accurate distribution by disposing a guide panel at each exits to vary the quantity of the pulverized coal in association with variation in air quantity, since the air quantity varies with the change of a damper of the mill exit pipe for conveying the pulverized coal on the air current is disclosed (for example, see Patent Citation 1).

Patent Document 1: Japanese Unexamined Patent Application, Publication No. HEI10-57828 (see FIG. 1 and FIG. 4)

DISCLOSURE OF INVENTION

In the roller mill 10 described above, the interior of the mill body 11 is in a state of mixed flow with the pulverized coal and primary air. However, since the fine particle exits 14 are provided at four positions with respect to the three rollers 13 in the interior of the mill body 11, a concentration deviation occurs in the lateral cross-sectional plane of the mill due to the axial asymmetry or the like. In other words, as shown in FIG. 7 for example, since there arise areas Mc having a high concentration of the pulverized coal at three points between the adjacent rollers 13, the distributed flow rates of the pulverized coal passing through the rotary classifier 20 and flowing out from the four fine particle exits 14 to the pulverized coal tubes 2 are not uniform depending on the positional relation with respect to these areas Mc.

Since the flow rate of the pulverized coal distributed at the each fine particle exit 14 corresponds to the quantity of fuel supplied to a burner unit provided at each surface of the furnace 1, the load of the burner and the burning state are different from each other among the burners on the wall surface of the furnace due to the nonuniformity of the distributed flow rate among the fine particle exits 14. Therefore, such nonuniformity of the distributed flow rate is not preferably because it may cause deterioration of the burning state in the entire boiler and generation of temperature deviation on the wall surface of the furnace 1. In particular, the boiler in recent years has a difficulty to secure a sufficient distance for rectification to achieve uniform distribution in association with cost reduction and space saving.

In view of such circumstances, it is an object of the present invention to provide a roller mill structure which achieves uniform distribution of fine particles passed through a rotary classifier to fine particle exits disposed at four points when conveying the fine particles such as pulverized coal milled in the roller mill on the air current.

In order to solve the above described problem, following solutions are employed in the present invention.

A roller mill structure according to a first aspect of the present invention is a roller mill structure configured to discharge fine particles obtained by milling a material to be milled, which is loaded in a mill body, from a plurality of fine particle exits formed on the top of the mill so as to be separated in the circumferential direction to the outside by air current conveyance, including: a table which rotates in the mill body, a plurality of rollers for rotating on the table and milling the material to be milled and a rotary classifier disposed upstream of the fine particle exits, characterized in that a rectifying device for partly narrowing the cross-sectional area of a flow channel is provided at a midpoint of the flow channel for fine particle current flowing into the interior of the rotary classifier and proceeding toward the fine particle exits.

According to the first aspect of the present invention described above, since the table which rotates in the mill body, the plurality of rollers for rotating on the table and milling the material to be milled, and the rotary classifier disposed upstream of the fine particle exits are provided and the rectifying device for partly narrowing the cross-sectional area of the flow channel is provided at a midpoint of the flow channel for fine particle current flowing into the interior of the rotary classifier and proceeding toward the fine particle exits, the flow of the fine particle current is controlled by the rectifying device and the flow rates of the powder flowing out from the fine particle exits are uniformized.

In the first aspect of the present invention, the rectifying device preferably operates so as to be capable of adjusting the cross-sectional area of the flow channel. In this case, since the flow velocity of the fine particle current varies with the cross-sectional area of the flow channel, the distribution of the concentration of the powder in the lateral cross-sectional plane in the rotary classifier may be uniformized.

In the first aspect of the present invention, the rectifying device is preferably arranged between the fine particle exits circumferentially separated and positioned adjacent to each other, thereby being capable of controlling the fine particle current on the upstream sides of the fine particle exits.

A roller mill structure according to a second aspect of the present invention is a roller mill structure configured to discharge fine particles obtained by milling a material to be milled, which is loaded in a mill body, from a plurality of fine particle exits formed on the top of the mill so as to be separated in the circumferential direction to the outside by air current conveyance, including: a table which rotates in the mill body, a plurality of rollers for rotating on the table and milling the material to be milled, and a rotary classifier disposed upstream of the fine particle exits, characterized in that part of fluid for air current conveyance is supplied from the periphery of the rotary classifier provided on the upper portion in the interior of the mill body into the mill body.

According to the second aspect of the present invention, since the table which rotates in the mill body, the plurality of rollers for rotating on the table and milling the material to be milled and the rotary classifier disposed upstream of the fine particle exits are provided, and part of fluid for air current conveyance is supplied from the periphery of the rotary classifier provided on the upper portion in the interior of the mill body into the mill body, the concentration of the powder may be uniformized by stirring the powder and the fluid for air conveyance in the mill body.

In the second aspect of the present invention, the rollers are preferably disposed in axial symmetry with respect to the fine particle exits. In other words, when the fine particle exit is quartered circumferentially at regular pitches, it is preferably arranged the four rollers at 90 degrees pitches so as to be in axial symmetry with respect to the four fine particle exits at four positions. Consequently, the axial symmetry in the interior of the mill body is secured by the four circumferentially quartered fine particle exits formed on the top of the mill body and the four rollers.

According to the roller mill structure according to the present invention described above, even when the number of rollers in the interior of the roller mill and the number of fine particle exits are in axial asymmetry when the fine particle such as the pulverized coal milled in the roller mill is conveyed on the air current, the fine particle passed through the rotary classifier are distributed uniformly to the fine particle exits disposed at a plurality of positions. Therefore, in the pulverized coal fired boiler in which the piping on the downstream side of the roller mill is oriented in the horizontal direction in association with the cost reduction or space saving of the boiler installation space as well, uniform distribution of the pulverized coal as fuel and hence maintenance of satisfactory burning quality, and significant improvement and restrain of the temperature deviation or the like of the furnace walls are achieved, so that remarkable improvement in reduction of boiler manufacturing cost and in performance and reliability thereof are achieved.

EXPLANATION OF REFERENCE

Figure 1:
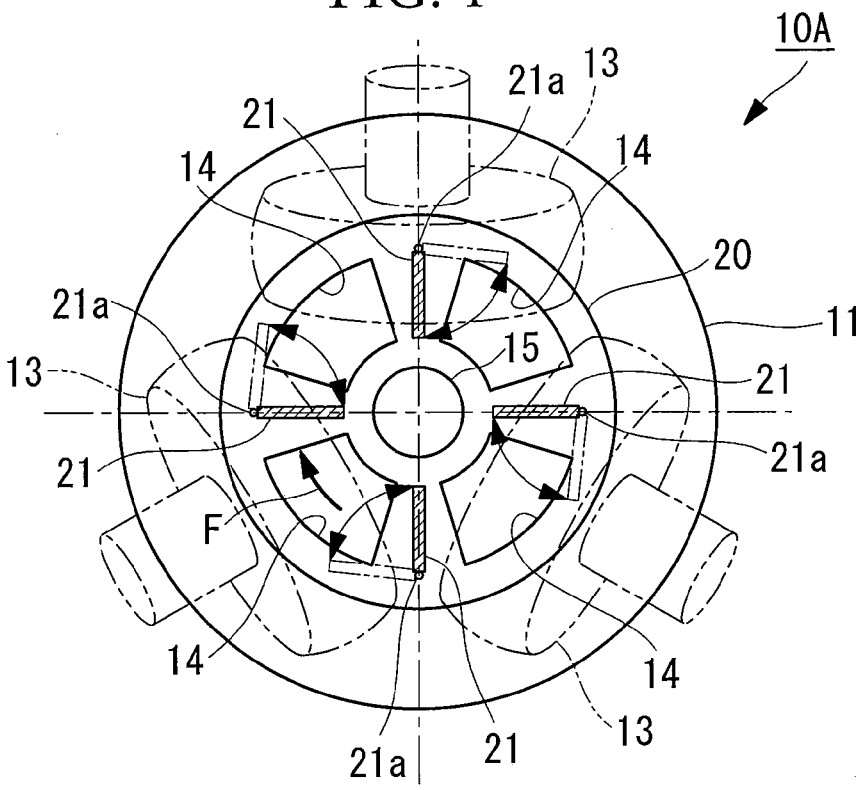
FIG. 1 is a plan view showing a first embodiment of a roller mill structure according to the present invention.

10A, 10B, 10C: roller mill
11: mill body
12: rotary table
13: roller
14: fine particle exit
20: rotary classifier
21: movable vane
30: stirring nozzle

BEST MODE FOR CARRYING OUT THE INVENTION

Referring now to the drawings, an embodiment of a roller mill structure according to the present invention will be described. Although the roller mill is used for milling raw coal (coal) of a material to be milled to obtain pulverized coal (fine particle) in the embodiments shown below, the present invention is not limited thereto.

First Embodiment

Figure 2:
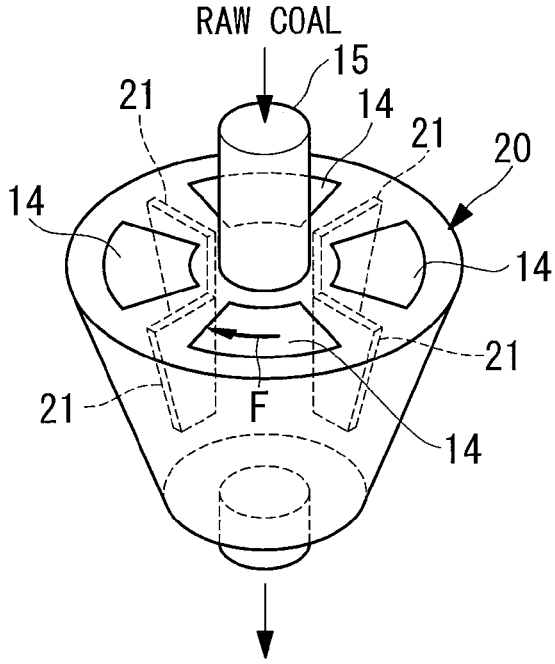
FIG. 2 is a perspective view showing a schematic configuration of a rotary classifier shown in FIG. 1.

A roller mill 10A according to an embodiment shown in FIG. 1 and FIG. 2 is configured to mill raw coal loaded in a mill body 11 to obtain pulverized coal and discharge the pulverized coal from circumferentially quartered fine particle exits 14 on the top of the mill body to the outside by air current conveyance.

The roller mill 10A includes a rotary table 12 (see FIG. 6) which rotates in the mill body 11, three rollers 13 for milling the raw coal by turning on the rotary table 12 and a rotary classifier 20 disposed upstream of the fine particle exits 14. The rollers 13 in this case are three rollers arranged at regular pitches circumferentially of the rotary table 12 and are turned with the upper surface of the rotary table 12 in association with the rotation thereof.

Opening on the top of the mill body 11 are the fine particle exits 14 for discharging the pulverized coal classified in the rotary classifier 20 to the outside through the air current conveyance. The fine particle exits 14 open substantially in a state of being circumferentially quartered in plan view on the top of the rotary classifier 20, and the above-described pulverized coal tubes 2 are connected to the fine particle exits 14, individually. In other words, the rotary classifier 20, being formed into a substantially truncated conical shape, has the circumferentially quartered fine particle exits 14 opened on the top thereof.

Figure 5:
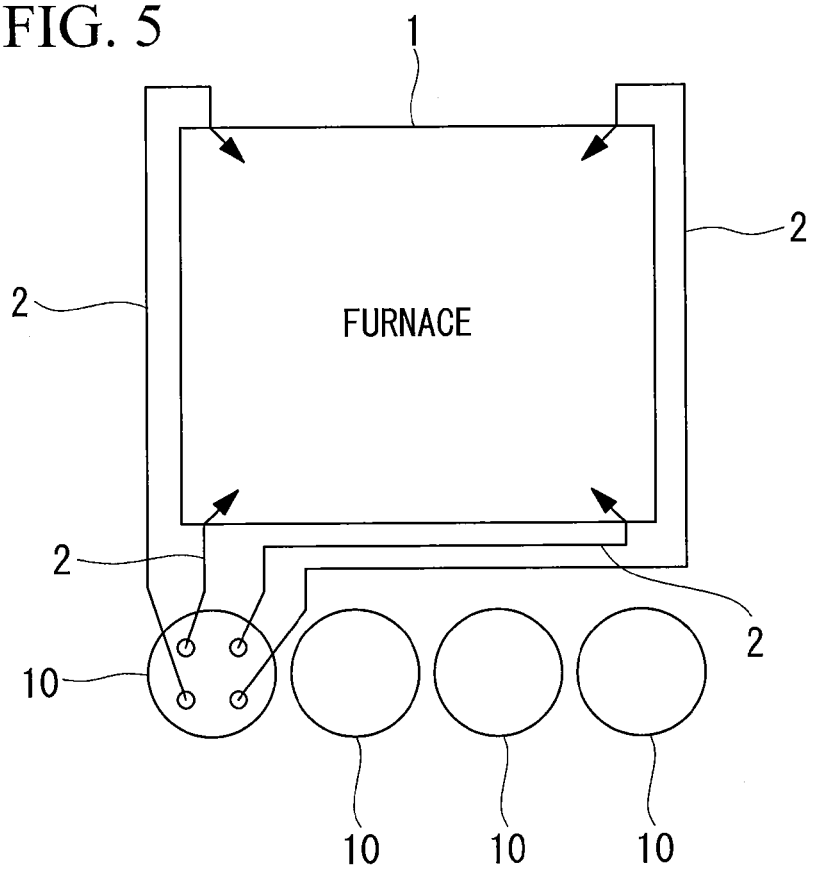
FIG. 5 is a fuel supplying system diagram of a pulverized coal fired boiler in which the roller mill is employed.

In this manner, the roller mill 10A shown in the drawing is an apparatus for milling the raw coal loaded from a raw coal adding tube 15 which penetrates through the center of axis of the rotary classifier 20 into the mill body 11 between the rotary table 12 and the rollers 13, and supplying the pulverized coal having a predetermined grain diameter or smaller one separated by the rotary classifier 20 to the furnace 1 shown in FIG. 5 through the air current conveyance.

Figure 6:
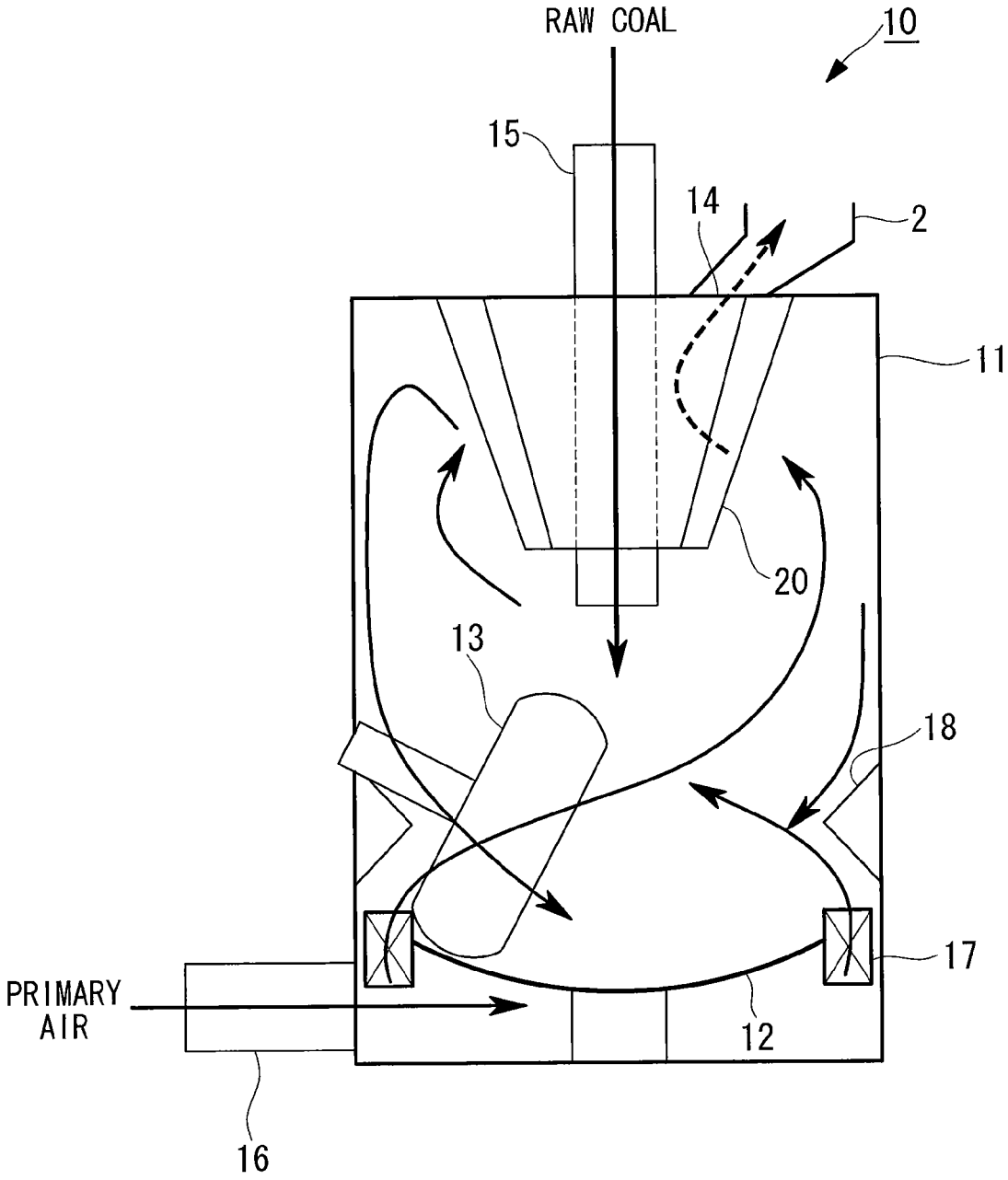
FIG. 6 is a cross-sectional view showing an example of the internal configuration of the roller mill structure in the related art.
Figure 7:
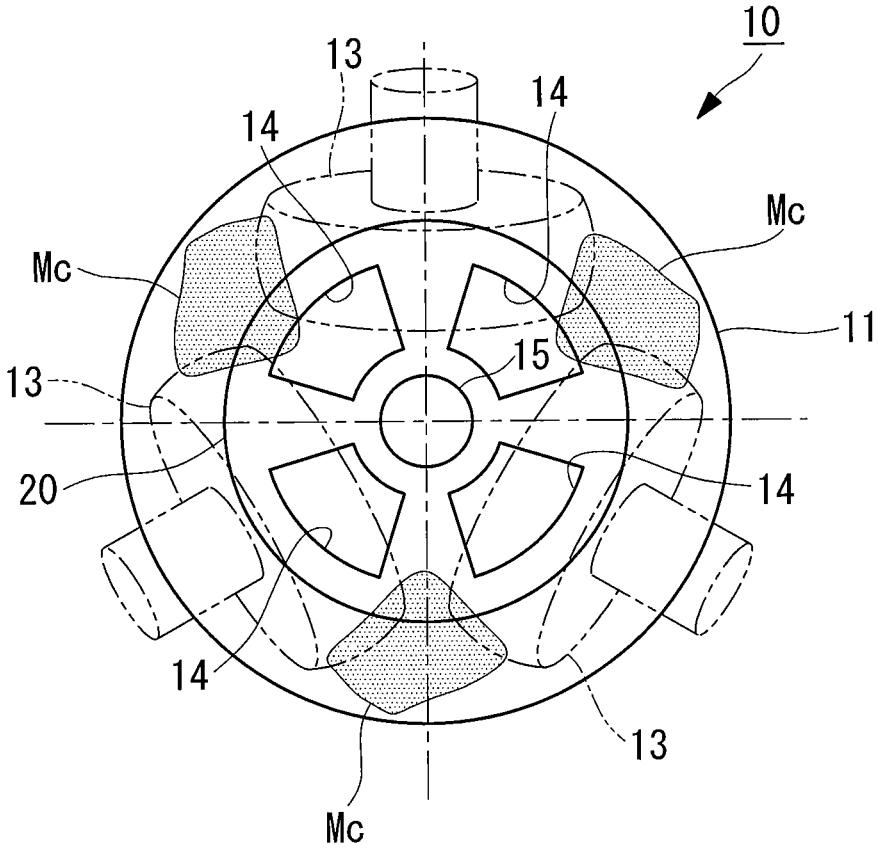
FIG. 7 is a plan view of the roller mill structure shown in FIG. 6.

Primary air for the air current conveyance is supplied through an air-supply pipe 16 connected to the lower portion of the mill body 11, and is flowed out from air outlet 17 disposed on the outer peripheral portion of the rotary table 12 into the mill body 11 to convey the pulverized coal on the air current as in the case of the structure in the related art shown in FIG. 6. In the roller mill 10A in this embodiment as well, a vane 18 for introducing air current in the mill body 11 in the direction of axial center thereof to provide a rotation is disposed in the same manner as the structure in the related art shown in FIG. 6.

The roller mill 10A in this embodiment includes movable vanes 21 which function as a rectifying device for partly narrowing the cross-sectional area of a flow channel at a midpoint of the flow channel for fine particle current flowing into the interior of the rotary classifier 20 and proceeding toward the fine particle exits 14. The movable vanes 21 operate so as to be capable of adjusting the cross-sectional area of the flow channel for the fine particle current flowing into the interior of the rotary classifier 20, and are arranged between the circumferentially quartered fine particle exits 14.

In other words, the fine particle current flowing from the side surface of the rotary classifier 20 into the interior thereof flows upward in the inner space of the rotary classifier 20 while whirling in a nonuniform state having deviation in concentration of the pulverized coal due to the axial asymmetry in the interior of the mill body 11 described above. Since the fine particle current as such flows outward from the fine particle exits 14 opening on the top, the movable vanes 21 are arranged between the adjacent fine particle exits 14 individually and the movable vanes 21 are rotated individually, so that the cross-sectional area of the flow channel extending to the fine particle exits 14 are adjusted and the flow is controlled to resolve the nonuniformity.

The movable vanes 21 are panel-shaped damper members which pivot (open and close) about a revolving shaft 21*a*, extending in the vertical direction, supported on the side wall side (outer peripheral side) of the rotary classifier 20. The roller mill 10A shown in FIG. 1 is provided with the four movable vanes 21 at 90 degrees pitches so as to circumferentially quarter the inner space of the rotary classifier 20, which corresponds to the flow channel of the fine particle current in plan view.

The range of the pivotal movement of the movable vanes 21 is from a position having a minimum flow channel cross-section shown by a solid line in FIG. 1 to a position, having a maximum flow channel cross-section (indicated by imaginary lines in the drawing), rotated by substantially 90 degrees toward the downstream side in the direction of whirling of the fine particle current. In the example shown in the drawing, the fine particle current in the rotary classifier 20 flows clockwise (see an arrow F in the drawing), the movable vanes 21 are able to pivot in a range from a position of a minimum flow channel cross-section (closed position) which substantially matches a diameter line passing through the axial center position of the rotary classifier 20 to a position, having a maximum flow channel cross-section (opened position), rotated leftward by substantially 90 degrees about the revolving shaft 21*a*. The position having a minimum flow channel cross section (closed position) in this case is not a position where the flow channel of the fine particle current is totally closed.

Since the roller mill 10A configured in this manner is provided with the movable vanes 21 at a midpoint of the flow channel of the fine particle current having a concentration deviation which enters the interior of the rotary classifier 20 and proceeds toward the fine particle exits 14 while whirling, the cross-sectional area of the flow channel for the fine particle current may be adjusted partly by the operation of the movable vanes 21. Therefore, since the cross-sectional area of the flow channel varies with the opening-closing positions of the movable vanes 21, the flow of the fine particle current is controlled according to the cross-sectional area of the flow channel, so that the flow rate of the pulverized coal flowing out from the fine particle exit 14 may be uniformized.

In other words, when the concentration deviation of the pulverized coal occurs in the lateral cross-sectional plane of the mill due to the axial asymmetry between the three rollers 13 and the fine particle exits 14 at the four positions, the flow channel on the upstream sides of the fine particle exits 14 may be set to have an optimal cross-sectional area according to the concentration deviation individually by controlling the opening of the four movable vanes 21 corresponding to the fine particle exits 14 at the four positions individually.

Consequently, for example, when the cross-sectional area of the flow channel is adjusted by reducing the opening of the movable vanes 21 in the area in which the concentration of the pulverized coal is high, and increasing the opening of the movable vanes 21 in the area in which the concentration of the pulverized coal is low, the reduced flow is generated according to the varying cross-sectional area of the flow channel and hence the flow velocity of the fine particle current varies. Therefore, uniformization of the distribution of the concentration of the fine particle in the lateral cross-sectional plane in the rotary classifier 20 is achieved.

In other words, since the movable vanes 21 are able to control the flow of the fine particle current on the upstream sides of the individual fine particle exits 14 by being arranged between the each adjacent fine particle exits 14 which are circumferentially separated and positioned adjacent to each other, even when the fine particle current flows therein in a state of nonuniform concentration distribution, it is uniformized in concentration distribution of the fine particle in the rotary classifier 20 and hence is distributed uniformly from the individual fine particle exits 14. In other words, the pulverized coal milled in the roller mill 10A, having passed through the rotary classifier 20, is controlled to avoid the nonuniform concentration distribution, thereby being distributed uniformly from the four fine particle exits 14 to the individual pulverized coal tubes 2.

Although the rectifying device in the embodiment shown above is movable vanes 21, the roller mill structure in the present invention may simply be provided with a rectifying device which is able to partly narrow the cross-sectional areas of the flow channel at a midpoint of the flow channels for the fine particle current flowing into the interior of the rotary classifier 20 and proceeding toward the fine particle exits 14.

Therefore, for example, it is also possible to insert a rectifier panel of an inverted cone shape at some midpoint of a route from a point where the fine particle current flows into the rotary classifier 20 having the conical side surface shape, through the interior thereof and the fine particle exits 14 opened at four positions to the pulverized coal tubes 2, so that the flow of the fine particle current flowed into the rotary classifier 20 is reduced to be supplied to the center of the roller mill 10A.

In other words, with the flow channel structure in which the flow channel of the fine particle current flowed into the interior of the rotary classifier 20 is narrowed once, increase of the flow velocity and the deviation of the concentration distribution in the lateral cross-sectional plane of the classifier may be corrected, whereby uniformity of the flow rate of the pulverized coal flowing out from the fine particle exits 14 at four positions to the pulverized coal tubes 2 is secured.

In a case in which the rectifying device which is able to perform variable control of the cross-sectional area of the flow channel by the adjustment of the opening as the movable vanes 21 described above is employed, when sensors are provided in the pulverized coal tubes 2 or the entrance of the burner to detect the state of flow (the flow rate of the pulverized coal or the like) for each fine particle exit 14 for example, the opening of the movable vanes 21 may be adjusted automatically and individually according to the result of detection. Therefore, fine control of supplying of the milled pulverized coal is easily achieved, so that the controllability is improved.

Second Embodiment

Figure 3:
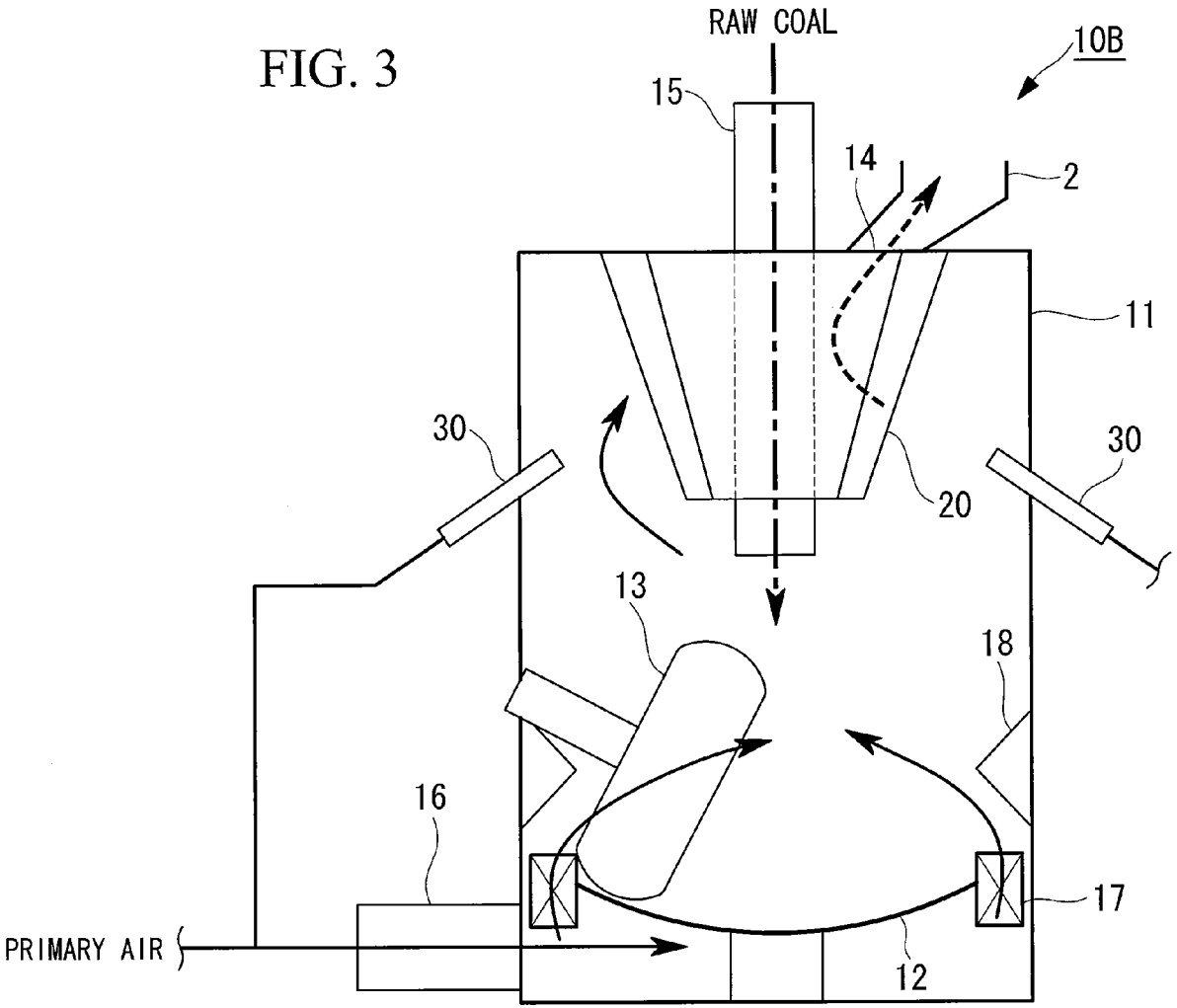
FIG. 3 is a drawing showing a second embodiment of the roller mill structure according to the present invention, which is a cross-sectional view showing an example of the interior configuration.

Referring now to FIG. 3, a second embodiment of the roller mill structure according to the present invention will be described. Components which are the same as those in the embodiment shown above are designated by the same reference numerals, and detailed description will be omitted.

A roller mill 10B in this embodiment is configured to supply part of the fluid for the air current conveyance to the interior of the mill body 11 from the periphery of the rotary classifier 20 disposed on the upper portion in the mill body 11 instead of uniformizing the concentration of the pulverized coal by the rectifying device. In other words, one or a plurality of stirring nozzles 30 are provided in the periphery of the rotary classifier 20 to introduce part of the primary air from the stirring nozzles 30 and inject the same into the mill body 11, so that the fine particle current before being flowed into the rotary classifier 20 is stirred and the concentration of the pulverized coal is uniformized.

The stirring nozzles 30 each are provided at an angle of injection in the direction of accelerating the fine particle current generated in the mill body 11 and increasing the whirling force. In this case, the flow velocity of the primary air injected from the stirring nozzles 30 is preferably set to a relatively high flow velocity (for example, 10 m/sec to 30 m/sec) so as to accelerate the fine particle current.

The preferable position of the stirring nozzles 30 is the periphery of the rotary classifier 20 and intermediate between of the adjacent fine particle exits 14 in the circumferential direction. Therefore, when the fine particle exits 14 are provided at four positions, four stirring nozzles 30 may be provided.

The quantity of the primary air for the air current conveyance to be distributed to the stirring nozzles 30 is preferably about 10% to 20% of the total supplying quantity, and remaining 80% to 90% are supplied from the air outlet 17 arranged around the rotary table 12 as before.

Since the roller mill 10B having the configuration described above is provided with the stirring nozzles 30 for injecting and supplying part of the primary air into the mill body 11 from the periphery of the rotary classifier 20 disposed in the upper portion in the mill body 11, the fine particle current in the mill body 11 may be stirred, so that the concentration of the pulverized coal is uniformized. In other words, the fine particle current of solid-gas two-phase flow containing the pulverized coal is stirred by the primary air for acceleration being injected from the stirring nozzles 30 provided on the outer wall side of the mill body 11 blasted thereto at a midpoint of whirling upward in the mill body 11 toward the rotary classifier 20, and the concentration of the pulverized coal is uniformized by dispersion and diffusion of the flow.

Since the uniformization of the concentration of the pulverized coal by stirring movement as described above is carried out before flowing into the rotary classifier 20, the uniformity of the flow rate of the pulverized coal flowing out from the fine particle exits 14 at four position provided in the rotary classifier 20 to the individual pulverized coal tubes 2 is also secured.

Since the configuration of this embodiment is able to uniformize the concentration of the pulverized coal inside and outside of the rotary classifier 20 by being combined with the first embodiment described above, the flow rate of the pulverized coal flowing out from the fine particle exits 14 to the pulverized coal tube 2 may further be uniformized.

Third Embodiment

Figure 4:
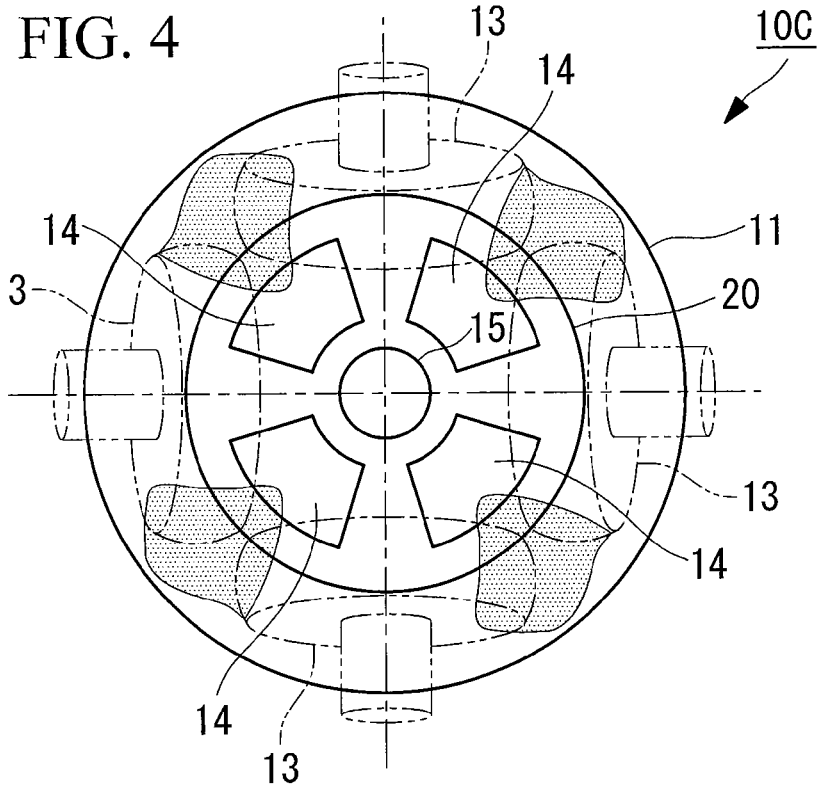
FIG. 4 is a plan view showing a third embodiment of the roller mill structure according to the present invention.

Referring now to FIG. 4, a third embodiment of the roller mill structure according to the present invention will be described. Components which are the same as those in the embodiment shown above are designated by the same reference numerals, and detailed description will be omitted.

A roller mill 10C in this embodiment includes the four rollers 13 at pitches of 90 degrees in association with the exit openings 14 at four positions. In other words, the rollers 13 and the fine particle exits 14 in this embodiment have a structure in which the axial asymmetry in the interior of the mill body 11 is substantially solved.

In this configuration, the nonuniformity of the concentration distribution of the pulverized coal generated in the lateral cross-sectional plane in the mill body 11 because of the axial asymmetry in the related art is improved, and there arises the areas Mc having a high concentration of the pulverized coal at the fine particle exits 14, so that the uniformity of the flow rate of the pulverized coal flowing out from the fine particle exits 14 to the pulverized coal tubes 2 may be secured.

The configuration of this embodiment may be combined with at least one of the first and second embodiments described above, so that the uniformity of the flow rate of the fine particle flowing out from the fine particle exits 14 to the pulverized coal tubes 2 may further be improved.

In this manner, according to the present invention described above, when carrying the fine particle such as the pulverized coal milled in the mill body 11 on the air current, the number of rollers in the interior of the mill body 11 and the number of fine particle exits are axially asymmetry, the fine particle passed through the rotary classifier 20 may be distributed uniformly to the fine particle exits at a plurality of points.

Therefore, in the pulverized coal fired boiler in which the piping on the downstream side of the roller mill is oriented in the horizontal direction in association with the cost reduction or space saving of the boiler installation space as well, uniform distribution of the pulverized coal as fuel and hence maintenance of satisfactory burning quality, and significant improvement and restrain of the temperature deviation or the like of the furnace walls are achieved. Consequently, the present invention is effective for the reduction of the manufacturing cost of the pulverized coal fired boiler as well as improvement of the performance and reliability thereof.

The present invention is not limited to the embodiments shown above, and may be modified in various manner as needed without departing from the scope of the present invention.

The invention claimed is:

1. A roller mill structure configured to discharge fine particles obtained by milling a material to be milled, which is loaded in a mill body, from a plurality of fine particle exits formed on the top of the mill body so as to be separated in the circumferential direction to the outside by air current conveyance, said roller mill structure comprising:

a table configured to rotate inside the mill body;

a plurality of rollers configured to rotate on the table and mill the material to be milled; and a rotary classifier disposed directly upstream of the plurality of fine particle exits, wherein a plurality of rectifying devices for partly narrowing a cross-sectional area of a flow channel are provided inside the rotary classifier, at a midpoint of the flow channel for fine particle current flowing into the interior of the rotary classifier and proceeding toward the plurality of fine particle exits, wherein each of the plurality of rectifying devices is rotated individually, and wherein the plurality of rectifying devices are configured with a plurality of panel-shaped damper members which pivot about a revolving shaft extending in a vertical direction, supported on a side wall side of the rotary classifier, so as to adjust the cross-sectional area of the flow channel.

2. The roller mill structure according to claim 1, wherein the fine particle exits are circumferentially separated and positioned adjacent to one another on the roller mill structure, and the plurality of rectifying devices are arranged between the fine particle exits.

3. The roller mill structure claim 2, wherein the rollers are disposed in axial symmetry with respect to the fine particle exits.

4. The roller mill structure according to claim 1, wherein the rollers are disposed in axial symmetry with respect to the fine particle exits.

5. The roller mill structure claim 1, wherein each of the plurality of rectifying devices are configured to pivot in a range from a first position of a minimum flow channel cross-section which substantially matches a diameter line passing through an axial center position of the rotary classifier to a second position, having a maximum flow channel cross-section, rotated leftward by substantially 90 degrees about the revolving shaft.

* * * * *